US010417961B2

(12) United States Patent
Xiang et al.

(10) Patent No.: US 10,417,961 B2
(45) Date of Patent: Sep. 17, 2019

(54) ORGANIC LIGHT-EMITTING DISPLAY PANEL AND DRIVING METHOD THEREOF, ORGANIC LIGHT-EMITTING DISPLAY DEVICE

(71) Applicants: Shanghai Tianma AM-OLED Co., Ltd., Shanghai (CN); Tianma Micro-Electronics Co., Ltd., Shenzhen (CN)

(72) Inventors: Dongxu Xiang, Shanghai (CN); Yue Li, Shanghai (CN); Tong Wu, Shanghai (CN); Renyuan Zhu, Shanghai (CN); Gang Liu, Shanghai (CN); Dong Qian, Shanghai (CN); Zeyuan Chen, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 0 days.

(21) Appl. No.: 15/488,576

(22) Filed: Apr. 17, 2017

(65) Prior Publication Data

US 2017/0221418 A1 Aug. 3, 2017

(30) Foreign Application Priority Data

Dec. 16, 2016 (CN) ..... 2016 1 1173823

(51) Int. Cl.
*G09G 3/3233* (2016.01)

(52) U.S. Cl.
CPC ... *G09G 3/3233* (2013.01); *G09G 2300/0426* (2013.01); *G09G 2300/0852* (2013.01);
(Continued)

(58) Field of Classification Search
None
See application file for complete search history.

(56) References Cited

U.S. PATENT DOCUMENTS 8,531,361 B2 9/2013 Nam
2006/0244388 A1 11/2006 Chung
(Continued)

FOREIGN PATENT DOCUMENTS

CN 101986378 A 3/2011
CN 102122490 A 7/2011
(Continued)

*Primary Examiner* — Matthew Yeung
(74) *Attorney, Agent, or Firm* — Anova Law Group, PLLC

(57) ABSTRACT

An organic light-emitting display panel, a driving method, and an organic light-emitting display device are provided. The organic light-emitting display panel comprises a plurality of pixel driving circuits, wherein a pixel driving circuit includes a first scan signal terminal and a second scan signal terminal; a light-emitting signal terminal, a data signal terminal, an initialization signal terminal, a first voltage terminal, and a second voltage terminal; a driving module comprising a driving transistor and a first capacitor having two electrode plates electrically connected to a gate electrode and a first electrode of the driving transistor, respectively; an initialization module comprising a first transistor, a first electrode, and a second electrode electrically connected to a second electrode of the driving transistor; a data writing module electrically connected to the gate electrode of the driving transistor; a light-emitting control module; and an organic light-emitting element.

20 Claims, 10 Drawing Sheets

(52) U.S. Cl.
CPC ..... *G09G 2300/0861* (2013.01); *G09G 2310/0251* (2013.01); *G09G 2310/0262* (2013.01); *G09G 2320/043* (2013.01)

(56) References Cited

U.S. PATENT DOCUMENTS

| | | | | |
|---|---|---|---|---|
| 2009/0046041 | A1* | 2/2009 | Tanikame | G09G 3/3233 345/76 |
| 2011/0199357 | A1* | 8/2011 | Chung | G09G 3/3233 345/211 |
| 2014/0055434 | A1* | 2/2014 | Chang | G09G 3/3233 345/208 |
| 2015/0002558 | A1 | 1/2015 | Kumeta et al. | |
| 2015/0243203 | A1 | 8/2015 | Kim et al. | |
| 2015/0243220 | A1* | 8/2015 | Kim | H01L 27/1225 345/215 |
| 2016/0293103 | A1* | 10/2016 | Kimura | G09G 3/3233 |
| 2017/0221418 | A1 | 8/2017 | Xiang et al. | |

FOREIGN PATENT DOCUMENTS

| | | | |
|---|---|---|---|
| CN | 103886831 | A | 6/2014 |
| CN | 104751781 | A | 7/2015 |
| CN | 105321472 | A | 2/2016 |

* cited by examiner

ORGANIC LIGHT-EMITTING DISPLAY PANEL AND DRIVING METHOD THEREOF, ORGANIC LIGHT-EMITTING DISPLAY DEVICE

CROSS-REFERENCES TO RELATED APPLICATIONS

This application claims priority of Chinese Patent Application No. 201611173823.X, filed on Dec. 16, 2016, the entire contents of which are hereby incorporated by reference.

FIELD OF THE DISCLOSURE

The present disclosure generally relates to the field of display technology and, more particularly, relates to an organic light-emitting display panel and a driving method thereof, and an organic light-emitting display device comprising the organic light-emitting display panel.

BACKGROUND

An organic light-emitting display device displays images based on the self-luminous characteristics of organic semiconductor materials, which has the advantages of high contrast, and low power consumption, etc. The display area of the organic light-emitting display device is often disposed with a pixel array including a plurality of sub-pixels. Each sub-pixel contains an organic light-emitting element, such as an organic light-emitting diode (OLED), which is driven by a pixel driving circuit to emit light.

An existing pixel drive circuit may include a driving transistor which supplies a light-emitting current to the OLED under the control of the light-emitting control signal. The light-emitting current of the OLED depends on the threshold voltage Vth of the driving transistor. However, the threshold voltage Vth of the driving transistor shifts due to factors such as manufacturing process, and aging after prolonged use, etc. Thus, the brightness, of the OLED may be unstable. In addition, in the existing pixel driving circuits, the driving transistor is operated at biases in the same direction over long time, such that the carrier mobility of the driving transistor may decay, and the pixel driving circuit, may be unable to work properly.

The disclosed organic light-emitting display panel and driving method thereof and organic light-emitting display device are directed to solve one or more problems set forth above and other problems.

BRIEF SUMMARY OF THE DISCLOSURE

One aspect of the present disclosure provides an organic light-emitting display panel. The organic light-emitting display panel comprises a plurality of pixel driving circuits arranged in a matrix, wherein a pixel driving circuit includes a first scan signal terminal and a second scan signal terminal; a light-emitting signal terminal, a data signal terminal, an initialization signal terminal, a first voltage terminal, and a second voltage terminal; a driving module comprising a driving transistor and a first capacitor having two electrode plates electrically connected to a gate electrode and a first electrode of the driving transistor, respectively; an initialization module comprising a first transistor having a gate electrode electrically connected to the first signal terminal, a first electrode electrically connected to the initialization signal terminal, and a second electrode electrically connected to a second electrode of the driving transistor; a data writing module electrically connected to the gate electrode of the driving transistor; a light-emitting control module comprising a second transistor having a gate electrode electrically connected to the light-emitting signal terminal, a first electrode electrically connected to the first voltage terminal, and a second electrode electrically connected to the second electrode of the driving transistor; and an organic light-emitting element having a cathode electrically connected to the second voltage terminal.

Another aspect of the present disclosure provides a driving method for an organic light-emitting display panel. The organic light-emitting display panel comprises a plurality of pixel driving circuits arranged in a matrix, wherein a pixel driving circuit includes a first scan signal terminal and a second scan signal terminal; a light-emitting signal terminal, a data signal terminal and an initialization signal terminal; a first voltage terminal, and a second voltage terminal; a driving module comprising a driving transistor and a first capacitor having two electrode plates electrically connected to a gate electrode and a first electrode of the driving transistor, respectively; an Initialization module comprising a first transistor having a gate electrode electrically connected to the first signal terminal, a first electrode electrically connected to the initialization signal terminal, and a second electrode electrically connected, to a second electrode of the driving transistor; a data writing module electrically connected to the gate electrode of the driving transistor; a light-emitting control module comprising a second transistor having a gate electrode electrically connected to the light-emitting signal terminal, a first electrode electrically connected to the first voltage terminal, and a second electrode electrically connected to the second electrode of the driving transistor; and an organic light-emitting element having a cathode electrically connected to the second voltage terminal. The driving method comprises: in a first stage, providing a first level signal to the first scan signal terminal and the second scan signal terminal, providing a second level signal to the light-emitting signal terminal, providing a first initialization signal to the initialization signal terminal, providing a second initialization signal to the data signal terminal, the initialization signal module writing the first initialization signal to the second electrode of the driving transistor, and the data signal terminal writing the second initialization signal to the gate electrode of the driving transistor; in a second stage, providing the first level signal to the light-emitting signal terminal and the second scan signal terminal, providing the second level signal to the first scan signal terminal providing a first signal to the data signal terminal, the data writing module transmitting the first signal to the gate electrode of the driving transistor, the driving transistor being turned on, the first voltage terminal charging the first electrode of the driving transistor; in a third stage, providing the second level signal to the first scan signal terminal and the light-emitting signal terminal, providing a data signal to the data signal terminal, the data writing module transmitting the data signal or a signal inputted by the first voltage terminal to the gate electrode of the driving transistor; and in a fourth stage, providing the first level signal to the light-emitting signal terminal, providing the second level signal to the first scan signal terminal and the second scan signal terminal and the organic light-emitting element emitting light according to a voltage difference between the gate electrode and the first electrode of the driving transistor, wherein a voltage of the second initialization signal is greater than a sum of a voltage of the first initialization signal and a threshold voltage of the driving transistor.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that, the described embodiments are some but not all of the embodiments of the present invention. Based on the disclosed embodiments, persons of ordinary skill in the art may derive other embodiments consistent with the present disclosure, all of which are within the scope of the present invention. Further, in the present disclosure, the disclosed embodiments and the features of the disclosed embodiments may be combined under conditions without conflicts.

Figure 1:
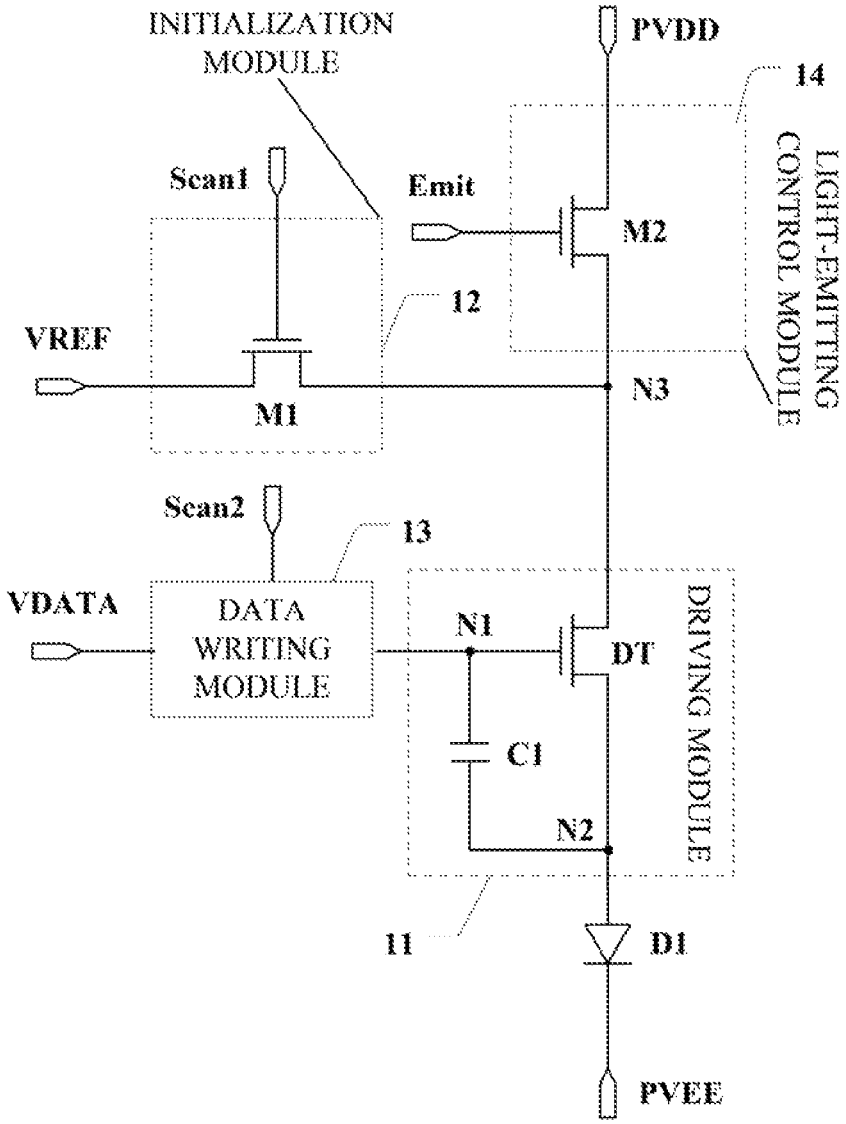
FIG. 1 illustrates a schematic view of an exemplary pixel driving circuit of an exemplary organic light-emitting diode display panel consistent with disclosed embodiments.

FIG. 1 illustrates a schematic view of an exemplary pixel driving circuit of an exemplary organic light-emitting display panel consistent with disclosed embodiments. In the disclosed embodiments, the organic light-emitting display panel may include a plurality of pixel driving circuits 100 arranged in a matrix.

As shown in FIG. 1, each pixel driving circuit 100 may include a first scan signal terminal Scan1, a second scan signal terminal Scan2, a light-emitting signal terminal Emit, a data signal terminal VDATA, an initialization signal terminal VREF, a first voltage terminal PVDD, a second voltage terminal PVEE, a driving module 11, an initialization module 12, a data writing module 13, a light-emitting control module 14 and an organic light-emitting element D1. The organic light-emitting element may be any suitable organic element that emits light. In one embodiment, the organic light-emitting element may be an organic light-emitting diode (OLED). That is, the organic light-emitting element D1 may be OLED D1.

If should be noted, although an OLED may be discussed in the present disclosure as one embodiment for the light-emitting element, the organic light-emitting element of the present disclosure is not limited to an OLED, and may be any suitable organic element that emits light. The OLED may be replaced with any suitable organic element that emits light, which is within the scope of the present disclosure.

The driving module 11 may include a driving transistor DT and a first capacitor C1. Two electrode plates (i.e., two terminals) of the first capacitor C1 may be electrically connected to the gate electrode of the driving transistor DT (node N1 as shown in FIG. 1) and the first electrode of the driving transistor DT (node N2 as shown in FIG. 1), respectively. The second electrode of the driving transistor DT (node N3 shown in FIG. 1) may be electrically connected to the light-emitting control module 14, for providing the light-emitting current to the anode of the OLED D1 under the control of the light-emitting control module 14.

The initialization module 12 may be electrically connected to the initialization signal terminal VREF, the first scan signal terminal Scan1, and the second electrode (node N3) of the driving transistor DT, for initializing the electric potential at the second electrode (node N3) of the driving transistor DT under the control of the first scan signal terminal Scan1. The initialization module 12 may include a first transistor M1 in which the gate electrode of the first transistor M1 may be electrically connected to the first scan signal terminal Scan1, the first electrode of the first transistor M1 may be electrically connected to the-initialization signal terminal VREF, and the second electrode of the transistor M1 may be electrically connected to the second electrode (node N3) of the driving transistor DT.

The data writing module 13 may be electrically connected to the gate electrode (node N1) of the driving transistor DT. The data writing module 13 may be configured to transmit the signal at the data signal terminal VDATA to the driving transistor DT, under the control of the second scan signal terminal.

The light-emitting control module 14 may be electrically connected to the light-emitting signal terminal Emit, the first voltage terminal PVDD and the driving module 11. The light-emitting control module 14 may include a second transistor M2. The gate electrode of the second transistor M2 may be electrically connected to the light-emitting signal terminal Emit. The first electrode of the second transistor M2 may be electrically connected to the first voltage terminal PVDD.

The cathode of the OLED D1 may be electrically connected to the second voltage terminal PVEE. The OLED D1 may emit light according to the voltage difference between the gate electrode and the first electrode of the driving transistor DT.

When the driving transistor DT is driving the OLED D1 to emit light, the electric potential at the gate electrode (node N1) of the driving transistor DT maybe higher than the electric potential at the first electrode (node N2) of the driving transistor DT. Accordingly, the node N2 may be the source electrode of the driving transistor DT, and the node N3 may be the drain electrode of the driving transistor DT, and the driving transistor DT may be operated under the bias voltage between the N1 node and the node N2.

In tile disclosed pixel driving circuits, before the OLED D1 is turned on, a first initialization signal may be written to the second electrode (node N3) of the driving transistor DT through the initialization module 12, and a second initialization signal may be written to the gate (node N1) of the driving transistor DT. The voltage of the first initialization signal may be lower than the voltage value of the second initialization signal. In addition, the voltage difference between the gate electrode (node N1) and the second electrode (node N3) of the driving transistor DT may be larger than the threshold voltage of the driving transistor DT, thereby turning on the driving transistor DT. Accordingly, the node N3 may be the source electrode of the driving transistor DT, the node N1 may be the gate electrode of the driving transistor DT, and the driving transistor DT may be operated under the bias voltage between the node N1 and the node N3.

Thus, before the OLED D1 is turned on, the bias voltage between the node N1 and the node N3 may have an opposite direction compared to the bias voltage at which the driving transistor DT turns on the OLED. That is, before the OLED D1 is turned on, the pixel driving circuit 100 may change the direction of the bias voltage of the driving transistor DT, such that the driving transistor DT may release the captured carries, and the decay rate of carrier mobility may be substantially reduced.

In addition, in the pixel driving circuit 100, two electrode plates of the first capacitor C1 may be connected to the gate electrode and the first electrode of the driving transistor DT. The electric potential at the gate electrode of the driving transistor may be controlled at a fixed electric potential through the data writing module 13.

Further, by charging the node N2 through the first voltage terminal PVDD, the electric potential of the node N2 may be increased until the electric potential difference between the node N1 and the node N2 is equal to the threshold voltage Vth of the driving transistor. Thus, the first capacitor C1 may maintain the electric potential difference between the two electrode plates of the first capacitor C1, i.e., maintain the threshold voltage Vth of the driving transistor DT. Thus, the electric potential at the node N2 may be a value including (−Vth).

Given the light-emitting current of the OLED is positively correlated with (Vgs−Vth), where Vgs is the electric potential difference between the node N1 and the node N2. When the electric potential of the node N1 is A (A is independent of Vth) after the data signal is written to the node N1, the light-emitting current may be A−(−Vth)−Vth=A. Thus, the light-emitting current may be independent of the threshold voltage Vth of the driving transistor DT. That is, the pixel driving circuit 100 may be able to compensate the threshold voltage drift of the driving transistor, thereby preventing the threshold voltage drift from influencing the luminance of the OLED D1.

Figure 2:
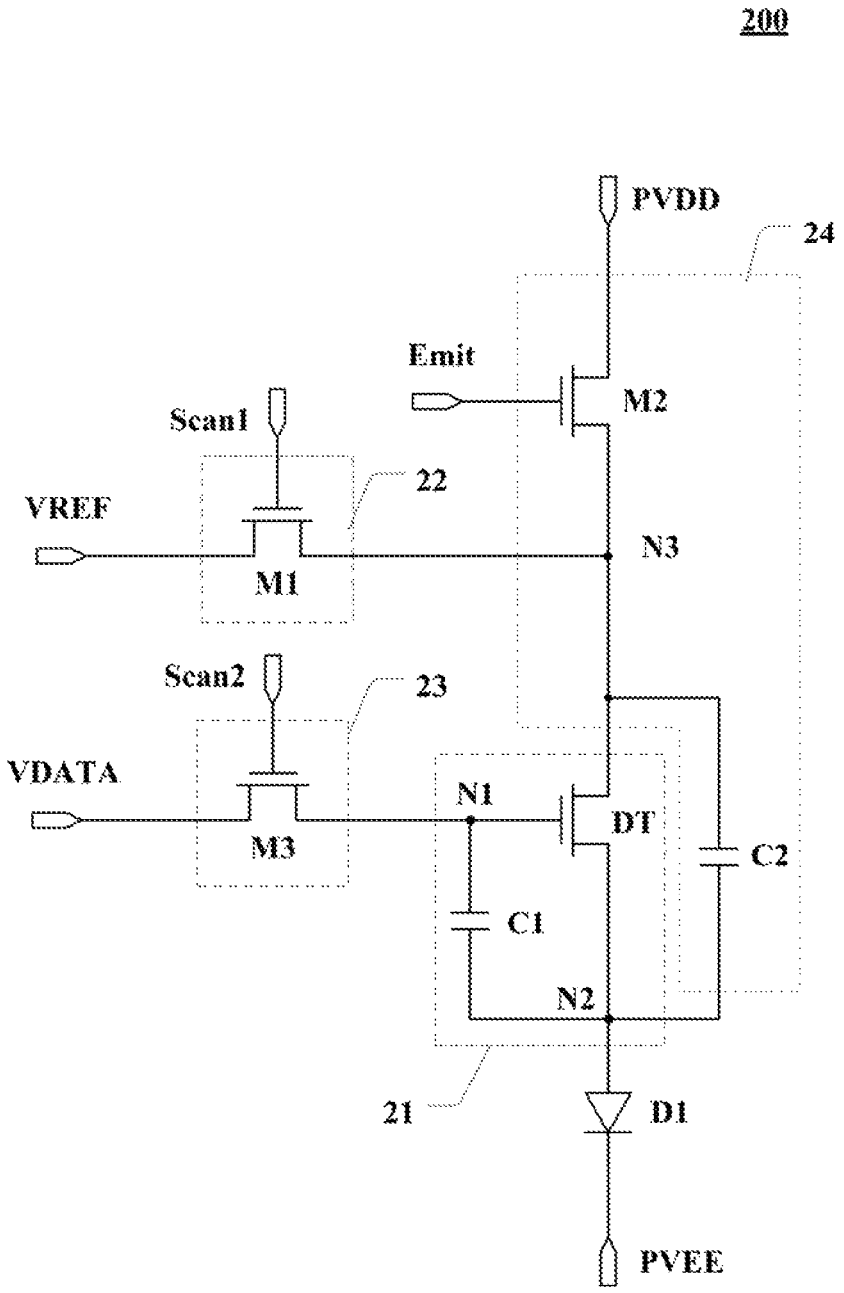
FIG. 2 illustrates an exemplary circuit diagram of an exemplary pixel driving circuit in FIG. 1 consistent with disclosed embodiments.

FIG. 2 illustrates an exemplary circuit diagram of an exemplary pixel driving circuit in FIG. 1 consistent with disclosed embodiments. As shown in FIG. 2, a pixel driving circuit 200 is provided on the basis of the pixel driving circuit 100 shown in FIG. 1. The similarities between FIG. 2 and FIG. 1 may not be repeated here, while certain differences may be explained.

As shown in FIG. 2, a data writing module 23 of the pixel driving circuit 200 may include a third transistor M3. The gate electrode of the third transistor M3 may be electrically connected to the scan signal terminal Scan2. The first electrode of the third transistor M3 may be electrically connected to the data signal terminal VDATA. The second electrode of the third transistor M3 may be electrically connected to the gate electrode of the driving transistor DT.

The data writing module 23 may write the signal of the data signal terminal VDATA to the gate electrode of the driving transistor DT, under the control of the second scan signal terminal Scan2. When writing the data signal, a data signal corresponding to the luminance of OLED D1 may be transmitted to the gate electrode of the driving transistor through the data signal terminal VDATA.

In one embodiment, when the OLED D1 is turned on to display a next frame, the electric potential of the gate electrode of the driving transistor DT may be initialized through the data signal terminal VDATA. For example, a signal having a substantially low electric potential may be provided through the data signal terminal VDATA. When the second scan signal terminal Scan2 turns on the third transistor M3, the gate electrode of the driving transistor DT may be initialized to the low potential.

The first electrode (N2 node) of the driving transistor DT may be electrically connected to the anode of the OLED D1. When the electric potential difference between the node N2 and the second voltage terminal PVEE is higher than the turn-on voltage of the OLED D1, the OLED D1 may emit light.

The light-emitting control module of the pixel driving circuit 200 may further include a second capacitor C2, both electrode plates of which may be electrically connected to the first voltage terminal PVDD and the first electrode (node N2) of the driving transistor DT, respectively. When the node N1 is written with the data signal and the node N2 is in a floating state, the electric potential of the node N2 may be increased due to the coupling effect of the first capacitor C1. Meanwhile, the first capacitor C1 and the second capacitor C2 may divide the voltage difference generated by the charges produced due to the coupling effect of the first capacitor C1, thereby preventing the voltage difference Vgs between the gate electrode and the source electrode (i.e. the first electrode) of the driving transistor DT from becoming substantially small and, accordingly, avoiding the insufficient luminance of the OLED D1.

Figure 3:
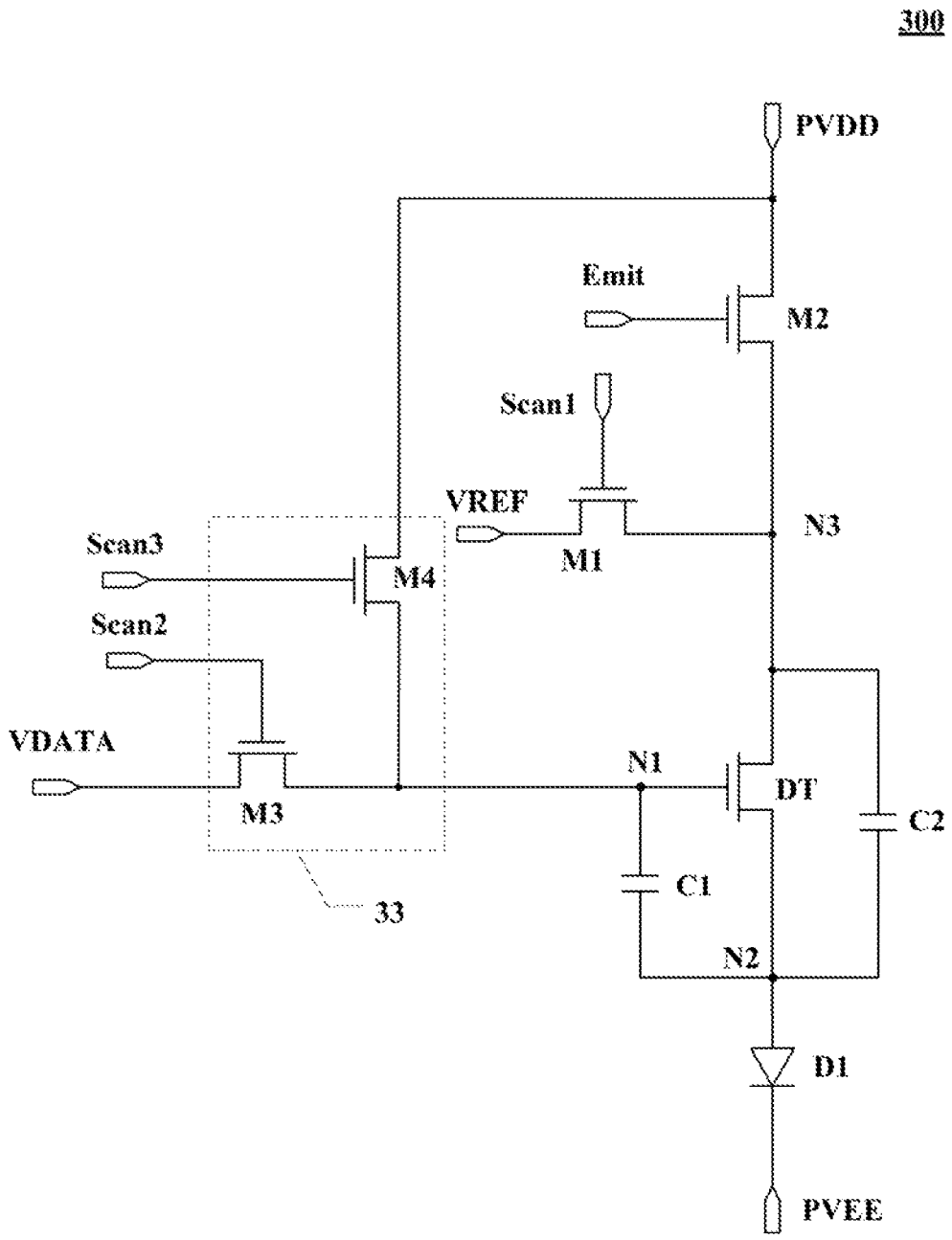
FIG. 3 illustrates another exemplary circuit diagram of an exemplary pixel driving circuit in FIG. 1 consistent with disclosed embodiments.

FIG. 3 illustrates another exemplary circuit diagram of an exemplary pixel driving circuit in FIG. 1 consistent with disclosed embodiments. As shown in FIG. 3, a pixel driving circuit 300 may be provided on the basis of the pixel driving circuit 200 shown in FIG. 2. The similarities between FIG. 3 and FIG. 2 may not be repeated here, while certain differences may be explained.

As shown in FIG. 3, the pixel driving circuit 300 may further include a third scan signal terminal Scan3. The data writing module 33 may further transmit the signal of the first voltage terminal PVDD to the driving transistor DT under control of the third scanning signal terminal Scan3. In one embodiment, as shown in FIG. 3, the data writing module 33 may further include a fourth transistor M4. The gate electrode of the fourth transistor M4 may be electrically connected to the third scan signal terminal Scan3. The first electrode of the fourth transistor M4 may be electrically connected to the first voltage terminal PVDD, and the second electrode of the fourth transistor M4 may be electrically connected to the gate electrode of the driving transistor DT.

The data writing module 13 may transmit the signal of the data signal terminal VDATA and the signal of the first voltage terminal PVDD to the gate electrode (node N1) of the driving transistor DT. In one embodiment, the third transistor M3 may be turned on under the control of the second scan signal terminal Scan2, such that the signal of the data signal terminal VDATA may be written to the node N1. The fourth transistor M4 may be turned on under the control of the third scan signal terminal Scan3, such that the signal of the first voltage terminal PVDD maybe written to the node N1, and the electric potential of the N1 node may change. Accordingly, the electric potential of the N2 may also change due to the coupling effect of the first capacitor C1, thereby driving the OLED D1 to emit light. In the process (i.e., driving the OLED D1 to emit light), the data signal terminal VDATA may only provide the data signal needed for displaying images to the gate electrode of the driving transistor DT, without providing an initialization signal to the gate electrode of the driving transistor DT. Thus, the signal stability of the data signal terminal VDATA may be improved, the display performance may be enhanced, while the power-consumption may be reduced.

Figure 4:
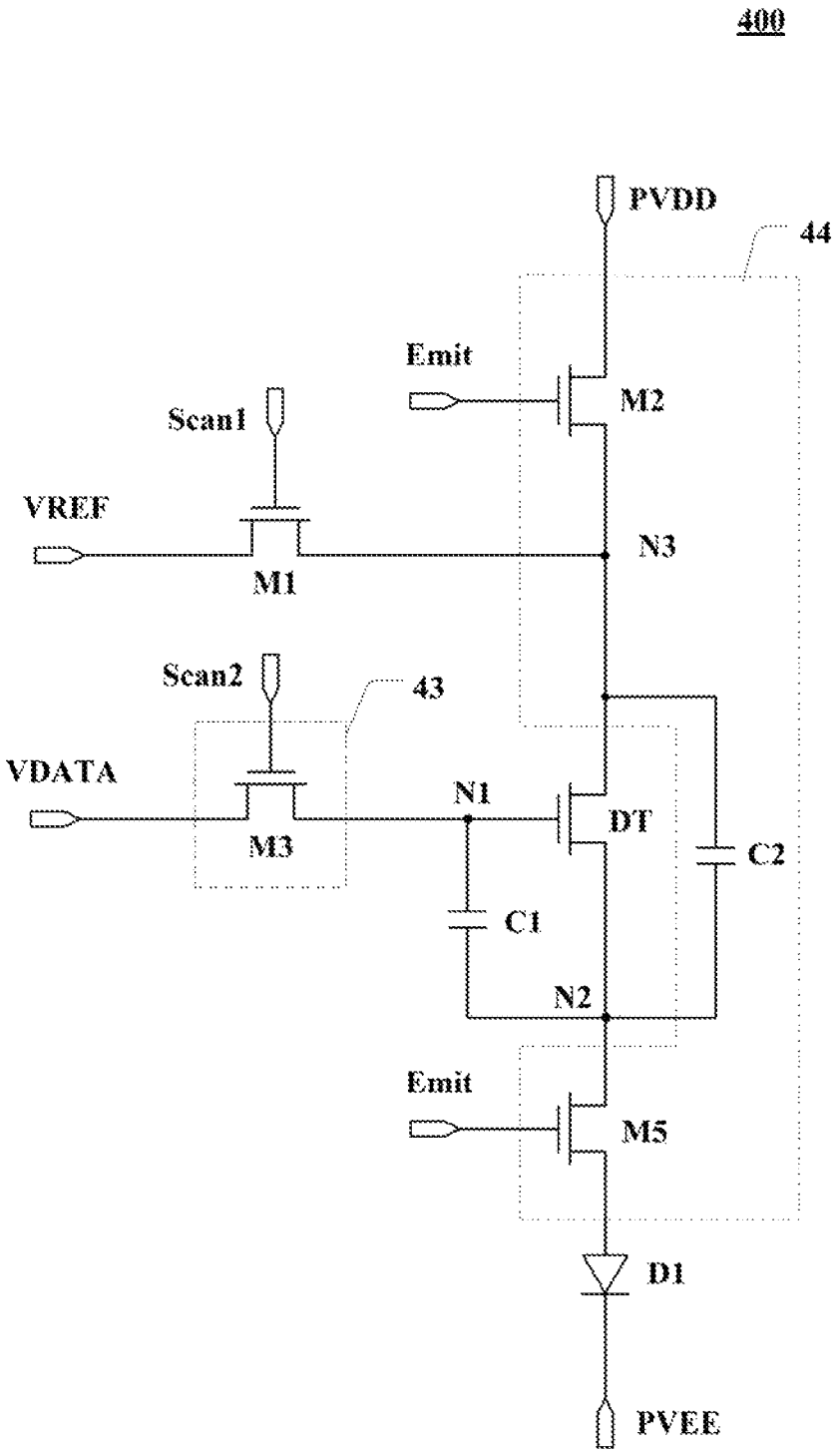
FIG. 4 illustrates another exemplary circuit diagram of an exemplary pixel driving circuit in FIG. 1 consistent with disclosed embodiments.

FIG. 4 illustrates another exemplary circuit diagram of an exemplary pixel driving circuit in FIG. 1 consistent with disclosed embodiments. As shown in FIG. 4, a pixel driving circuit 400 may be provided on the basis of the pixel driving circuit 100 shown in FIG. 1. The similarities between FIG. 4 and FIG. 2 may not be repeated here, while certain differences may be explained.

A data writing module 43 in the pixel driving circuit 400 shown in FIG. 4 may have the same circuit configuration as the data writing module 23 in the pixel driving circuit 200 shown in FIG. 2. The data writing module 43 may include a third transistor M3, in which the gate electrode of the third transistor M3 may be electrically connected to the second scan signal terminal Scan2, and the first electrode of the third transistor M3 may be electrically connected to the data signal terminal VDATA, and the second electrode of the third transistor M3 may be electrically connected to the gate electrode (node N1) of the driving transistor DT.

The light-emitting control module 44 may further include a fifth transistor M5 in addition to a second transistor M2. The gate electrode of the fifth transistor M5 maybe electrically connected to the emitter signal terminal Emit. The first electrode of the fifth transistor M5 may be electrically connected to the first electrode of the driving transistor DT, and the second electrode of the fifth transistor M5 may be electrically connected to the anode of the OLED D1.

Different from the pixel driving circuit 200 show in FIG. 2, the anode of the OLED D1 in the pixel driving circuit 400 shown in FIG. 4 may be indirectly connected via the fifth transistor M5, rather than being directly connected to the first electrode of the driving transistor DT. In the process of initialization, writing the data signal, and detecting the threshold voltage of the driving transistor DT, the electric potential of the node N2 may change. When the voltage difference between the node N2 and the second voltage signal terminal PVEE is higher than the turn-on voltage of the OLED D1, the fifth transistor M5 may be turned off, such that the OLED D1 may not emit light.

After the data is written and the threshold voltage Vth of the driving transistor DT is compensated, the fifth transistor M5 may be turned on to enable the OLED D1 to emit light. Thus, the OLED D1 may not emit light before the data signal is written and, meanwhile, the luminance of the OLED D1 may not be influenced by the threshold voltage of the driving transistor DT.

The present disclosure also provides an organic light-emitting display panel. The organic light-emitting display panel may include the disclosed pixel driving circuits arranged in a matrix.

Figure 5:
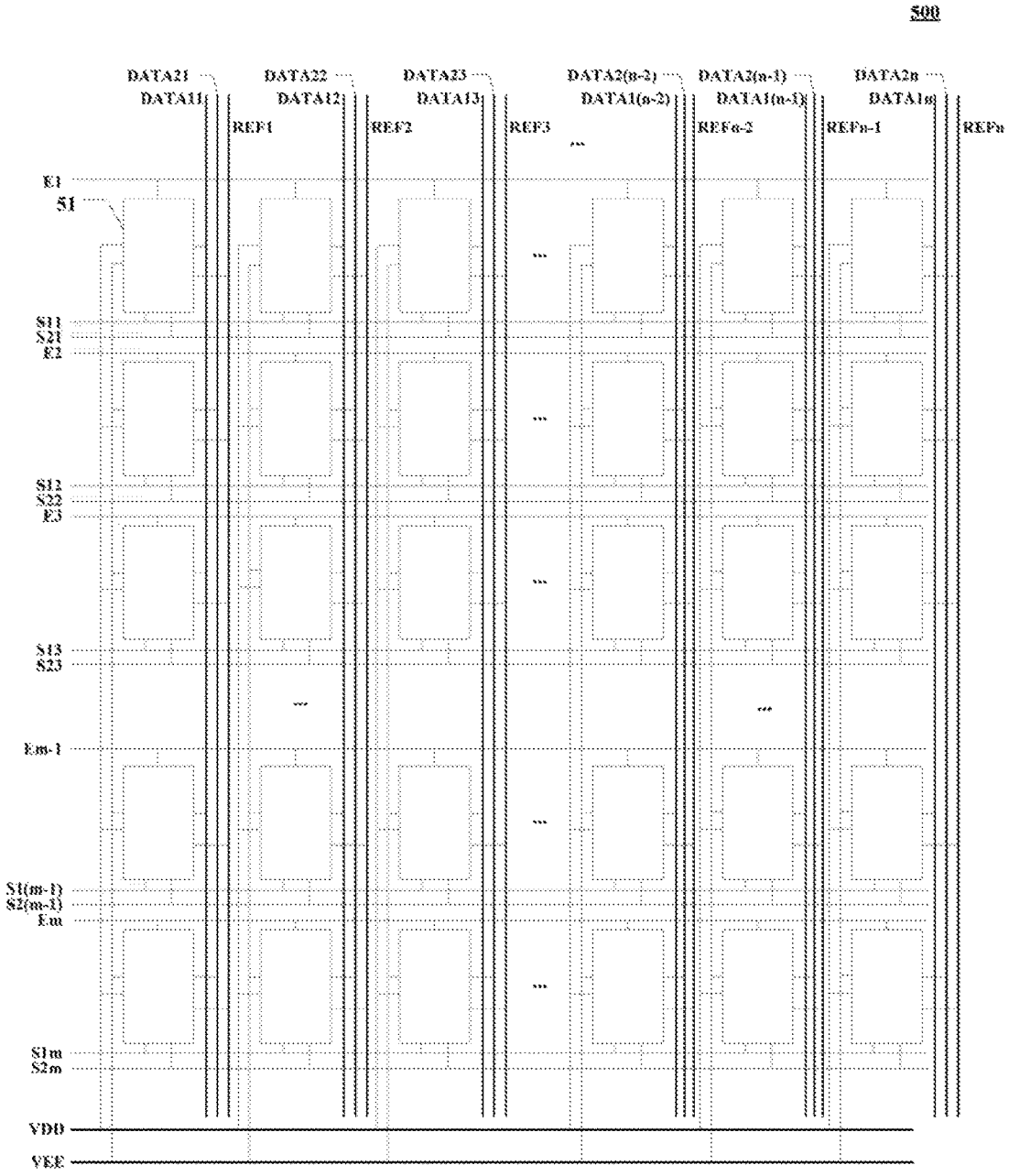
FIG. 5 illustrates a schematic view of an exemplary organic light-emitting display panel consistent with disclosed embodiments.

FIG. 5 illustrates a schematic view of an exemplary organic light-emitting display panel consistent with disclosed embodiments. As shown in FIG. 5, the organic light-emitting display panel 500 may include a plurality of pixel driving circuits arranged in a matrix. Each of the plurality of pixel driving circuits 51 may be one of the pixel driving circuits shown in FIGS. 1-4.

The organic light-emitting display panel 500 may further include a plurality of first scan signal lines S11, S12, S13, . . . , S1 (m-1), S1*m*, a plurality of second scan signal lines S21, S22, S23, . . . , S2 (m-1), S2*m*, a plurality of light-emitting lines E1, E2, E3, . . . , E (m-1), Em, a plurality of data signal lines DATA11, DATA21, DATA12, DATA22, DATA13, DATA23, . . . , DATA1(n-2), DATA2(n-2), DATA1(n-1), DATA2(n-1), DATA1*n*, DATA2*n*, at least one initialization signal line REF1, REF2, REF3, . . . , REF (n-2), REF(n-1), REFn, a first voltage signal line VDD, and a second voltage signal line VEE, where m and n are positive integers.

The first scan signal terminal Scan1 of each pixel driving circuit 51 may be electrically connected to a first scan signal line S11, S12, S13, . . . , S1(m-1) or S1*m*, and the second scan signal terminal Scan2 of each pixel driving circuit 51 may be electrically connected to a second scanning signal line S21, S22, S23, . . . , S2(m-1) or S2*m*. The light-emitting signal terminal limit of each pixel driving circuit 51 may be electrically connected Us a light-emitting signal line E1, E2, E3, . . . E(m-1) or Em. The data signal terminal VDATA of each pixel driving circuit 51 may be electrically connected to a data signal line DATA11, DATA21, DATA12, DATA22, DATA13, DATA23, . . . , DATA1(n-2), DATA2(n-2), DATA1(n-1), DATA2(n-1), DATA1*n* or DATA2*n*.

The initialization signal terminal VREF of each pixel driving circuit 51 may be electrically connected to an initialization signal line REF1, REF2, REF3, . . . , REF (n-2), REF (n-1) or REFn. The first voltage terminal PVDD of each pixel driving circuit 51 may be electrically connected to the first voltage signal line VDD. The second voltage terminal PVEE of each pixel driving circuit 51 may be electrically connected to the voltage signal line VEE.

As shown in FIG. 5, the data signal terminals in the pixel driving circuits 51 disposed in a same column each may be electrically connected to two data signal lines, and each of the two data signal lines may be electrically connected to a plurality of pixel driving circuits disposed in the same column. For example, a plurality of pixel driving circuit 51 in the first column (in the most left column of the pixel driving circuits 51 in FIG. 5) may be electrically connected to the data lines DATA11 and DATA21. Generally, the brightness of each subpixel may be different, the luminance of each OLED may be different, and the data signal received by each pixel driving circuit may be different. Thus, when one data signal line is connected to a plurality of pixel driving circuits, the data signal line may have to transmit different data signals to the different pixel drive circuits in different time (e.g., through time-sharing).

That is, within the time period for displaying a frame of image, the driving IC (integrated circuit) may have to control the signal transmitted by each data signal line to change several times. When the number of the data signal lines is increased, the number of the pixel driving circuits to be driven per data signal line may be reduced, and the changing rate of the signal transmitted by each data signal line may be reduced. Accordingly, the changing rate of the signal transmitted from the driving IC to each data signal line may be reduced, and the load of the driving IC may be reduced.

Further, as shown in FIG. 5, each first scan signal line S11, S12, S13, . . . , S1(m-1) or S1*m* may be electrically connected to the first scan signal terminals Scan1 of the pixel driving circuits 51 arranged in one row of pixel driving circuits 51, respectively. That is, each first scan signal line S11, S12, S13, . . . , S1(m-1) or S1*m* may be electrically connected to the first scan signal terminals Scan1 of the pixel driving circuits 51 arranged in one pixel driving circuit row.

Each second scan signal hue S21, S22, S23, . . . , S2(m-1) or S2*m* may be electrically connected to-the second scan signal terminals Scan2 of the one row of pixel driving circuits 51, respectively. That is, each second scan signal line S21, S22, S23, . . . , S2(m-1) or S2*m* maybe electrically connected to the second scan signal terminals Scan2 of the pixel driving circuits 51 arranged in one pixel driving row. Each light-emitting signal line E1, E2, E3, . . . , E(m-1) or Em may be electrically connected to the light-emitting signal terminals Emit of one row of pixel driving circuits 51, respectively. That is, each light-emitting signal line E1, E2, E3, . . . , E(m-1) or Em may be electrically connected to the light-emitting signal terminals limit of the pixel driving circuits 51 arranged in one pixel driving row. Each initialization signal line REF1, REF2, REF3, . . . , REF(n-2), REF(n-1) or REFn may be electrically connected to the initialization signal terminals VREF of one column of pixel driving circuits, respectively. That is, each initialization signal line REF1, REF2, REF3, . . . , REF(n-2), REF(n-1) or REFn may be electrically connected to the initialization signal terminals VREF of the pixel driving circuits 51 arranged in one pixel driving column.

The first voltage terminal PVDD of each pixel driving circuit 51 may be electrically connected, to the same voltage signal line VDD. The second voltage terminal PVEE of each pixel driving circuit 51 may be electrically connected to the same second voltage signal line VEE. In the display process, the pixel driving circuits disposed in the same pixel driving circuit row may be operated at a same time, and the OLEDs in the same pixel driving circuit row may be turned on at the same time. Thus, the OLEDs in the pixel driving circuit matrix may be turned on row by row to complete the display of the entire picture.

Figure 6:
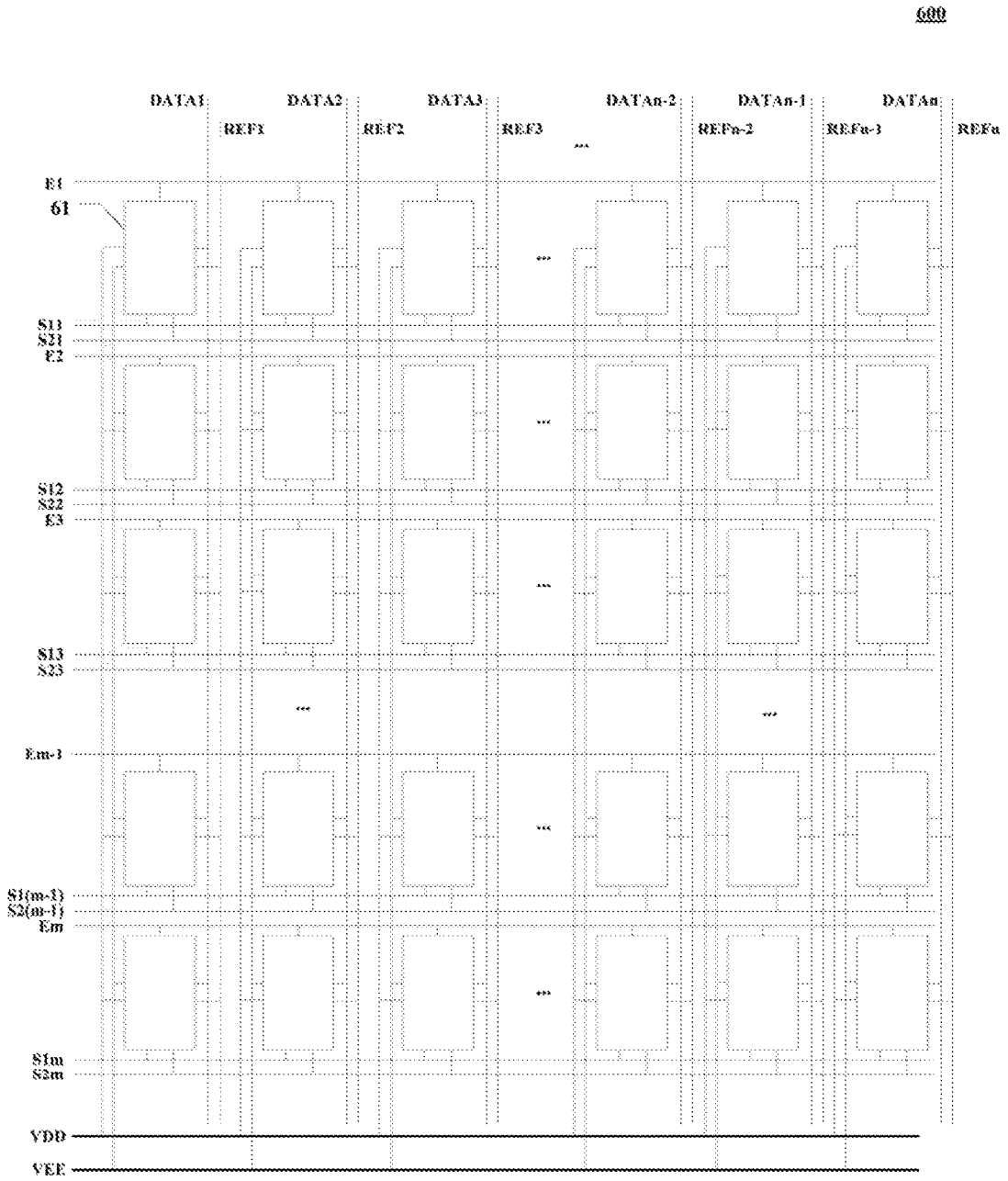
FIG. 6 illustrates a schematic view of another exemplary organic light-emitting display panel consistent with disclosed embodiments.

FIG. 6 illustrates a schematic view of another exemplary organic light-emitting display panel consistent with disclosed embodiments. The similarities between FIG. 5 and FIG. 6 may not be repeated here, while certain differences may be explained.

As shown in FIG. 6 Different from the organic light-emitting display panel 500 in FIG. 5, the organic light-emitting display panel 600 may include a plurality of data signal lines DATA1, DATA2, DATA3, . . . , DATA(n-2), DATA(n-1), and DATAn, where n is a positive integer. Each data signal line may be electrically connected to the data signal terminals of a column of pixel driving circuits 61, respectively. That is, each data signal line may he electrically connected to the data signal terminals of pixel driving circuits 61 in one pixel driving circuit column. The pixel driving circuits 61 disposed in a same column may be electrically connected to a same data signal line. Compared with the organic light-emitting display panel 500 in FIG. 5, the organic light-emitting display panel 600 in FIG. 6 may have a reduced number of data signal lines. Generally, the data signal lines are directly connected to the terminals of the driving ICs, or indirectly connected to the terminals of the driving ICs via time-sharing gates, and the number of the terminals of the driving ICs required for the data signal lines are positively correlated with the number of data signal lines. Thus, the organic light-emitting display panel 600 may be able to reduce the required terminals of the driving ICs, thereby simplifying the terminal design of the driving ICs.

Figure 7:
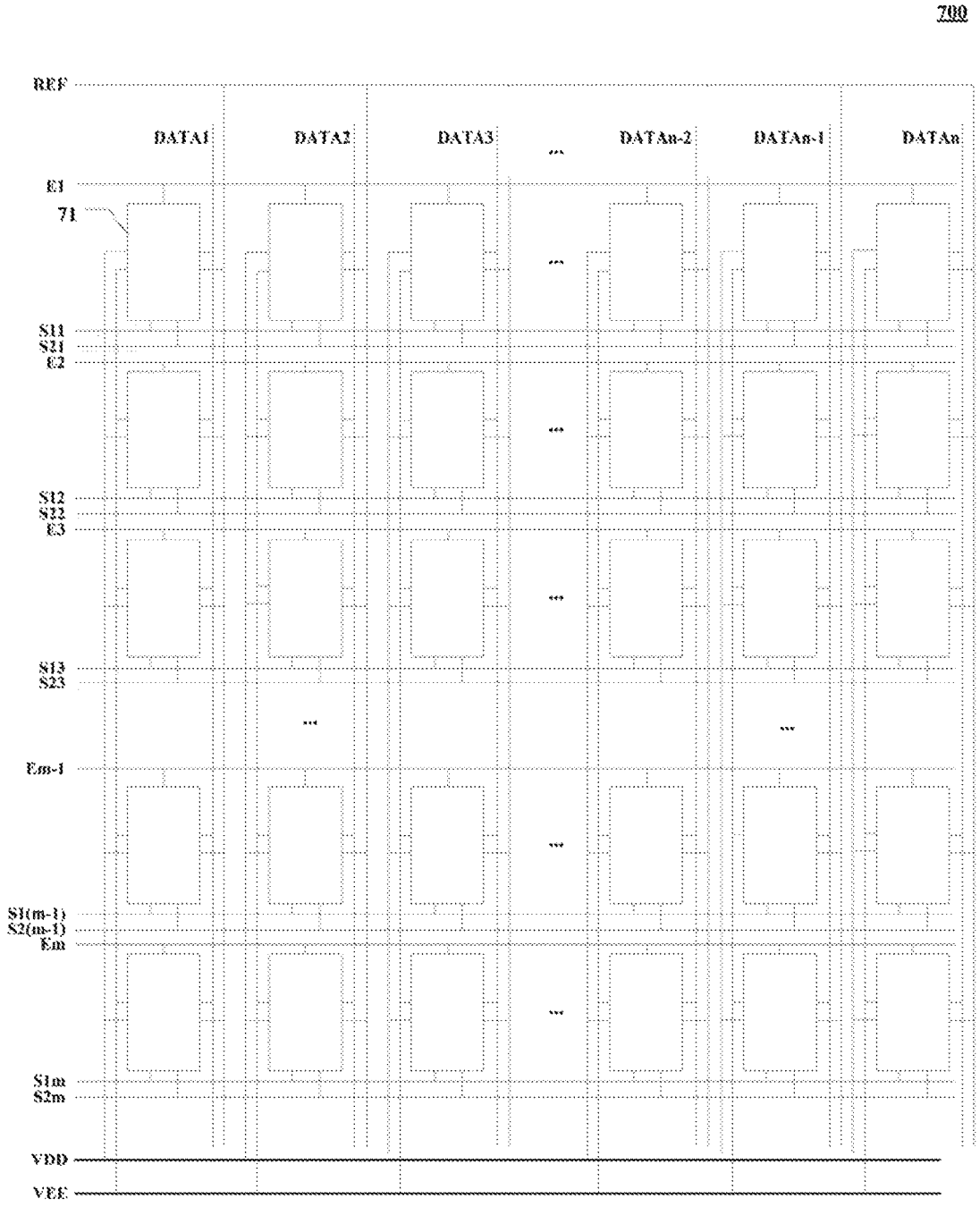
FIG. 7 illustrates a schematic view of another exemplary organic light-emitting display panel consistent with disclosed embodiments.

FIG. 7 illustrates a schematic view of another exemplary organic light-emitting display panel consistent with disclosed embodiments. The similarities between FIG. 6 and FIG. 7 may not repeated here, while certain differences may be explained.

As shown in FIG. 7, the initialization signal terminals of the plurality of pixel driving circuits 71 in the organic light-emitting display panel 700 may be electrically connected to the same initialization signal line REF. That is, each pixel driving circuit 71 may receive the initialization signal through the same initialization signal line REF, thereby further reducing the number of the signal lines connected to the driving ICs and reducing the number of the occupied terminals of the driving ICs.

The connection relations between each signal line and the pixel driving circuits in the organic light-emitting display panel of the present disclosure, shown in FIGS. 5-7, are for Illustrative purposes and are not intended to limit the scope of the present disclosure. In certain embodiments, each data signal line may be electrically connected to a plurality of pixel driving circuits disposed in different columns. Each first scan signal line may be electrically to a plurality of pixel driving circuits disposed in different rows. Each second scan signal line may be electrically to a plurality of pixel driving circuits disposed in different rows. Each light-emitting signal line may be electrically to a plurality of pixel driving circuits disposed in different rows. The number of the first voltage signal line and the number of the second voltage signal line are not limited to 1. The connection relations between each signal line and the pixel driving circuits, the number of the first voltage signal line, and the number of the second voltage signal line in the organic light-emitting display panel may vary according to various application scenarios.

It should be noted that, when the pixel driving circuit in the organic light-emitting display panel is the pixel driving circuit 300 shown, in FIG. 3, the organic light-emitting display panel may further include a plurality of third scanning signal lines (not shown in FIGS. 5-7), and the third scan signal terminal of each pixel driving circuit may be electrically connected to a third scan signal line. In one embodiment, each third scan signal line may be electrically connected to the third scan signal terminals of one row of pixel driving circuits, respectively. That is, each third scan signal line may be electrically connected to the third scan signal terminals of pixel driving circuits in one pixel driving circuit row.

It should be noted that, in the disclosed embodiments; the first transistor M1, the second transistor M2, the third transistor M3, the fourth transistor M4, the fifth transistor M5, and the driving transistor DT may each be an N-type transistor or a P-type transistor. When the driving transistor DT is an N-type transistor, the threshold voltage Vth>0. When the driving transistor is a P-type transistor, the threshold voltage Vth<0.

The present disclosure may also provide a driving method for the organic light-emitting display panel. In the disclosed driving method, the operation of each pixel driving circuit may include at least four stages.

In particular, in the first stage, a first level signal may be provided to the first scan signal terminal Scan1 and the second scan signal terminal Scan2, and a second level signal may be provided to the light-emitting signal terminal Emit. A first initialization signal may be provided to the initialization signal terminal VREF, and a second initialization signal may be provided to the data signal terminal VDATA. The initialization signal module may write the first initialization signal to the second electrode (node N3) of the driving transistor DT, and the data writing module may write the second initialization signal to the gate electrode (node N1) of the driving transistor DT.

In the second stage, a first level signal may be provided to the light-emitting signal terminal Emit and the second scan signal terminal Scan2. A second level signal may be provided to the first scan signal terminal Scan1. A first signal may be provided to the data signal terminal VDATA. The data writing module may transmit the first signal to the gate electrode (node N1) of the driving transistor DT, such that the driving transistor DT may be turned on. The first voltage terminal PVDD may charge the first electrode of the driving transistor DT.

In the third stage, a second level signal may be provided to the first scan signal terminal Scan 1, the light-emitting signal terminal Emit. A data signal may be provided to the data signal terminal VDATA. The data writing module may transmit the data signal or a signal inputted from the first voltage terminal PVDD to the gate electrode (node N1) of the driving transistor DT.

In the fourth stage, a first level signal may be provided to the light-emitting signal terminal Emit, and a second level signal may be provided to the first scan signal terminal Scan1 and the second scan signal terminal Scan2. The OLED D1 may emit light based on the voltage difference between the gate electrode (node N1) and the first electrode (node N2) of the driving transistor DT.

In the first stage of the disclosed driving method, the voltage of the second initialization signal may be configured to be greater than the stun of the voltage of the first initialization signal and the threshold voltage of the driving transistor.

The operating principle of each pixel driving circuit driven by the driving method will now be further illustrated with reference to FIGS. 8 and 9, based on the following exemplary configurations: each of the first transistor M1, the second transistor M2, the third transistor M3, the fourth transistor M4, the fifth transistor M5, and the driving transistor DT may be an N-type transistor, the first level signal in the driving method may be a high level signal, and the second signal level signal may be a low level signal.

Figure 8:
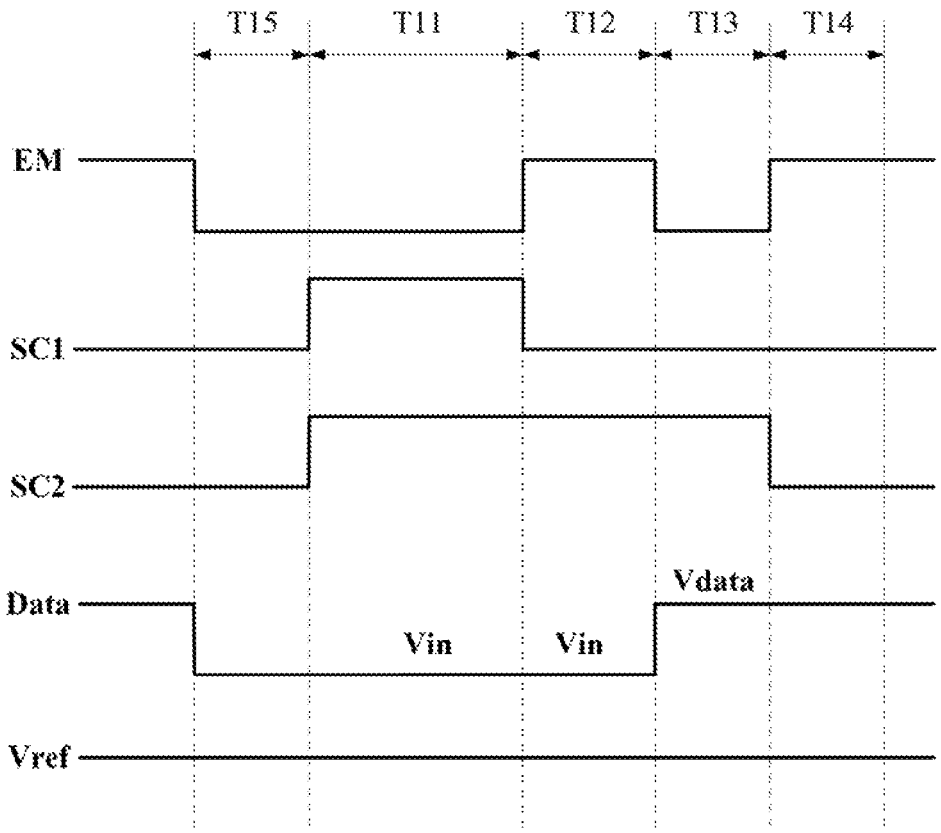
FIG. 8 illustrates an exemplary driving scheme of exemplary pixel driving circuits in FIG. 2 and FIG. 4 consistent with disclosed embodiments.
Figure 9:
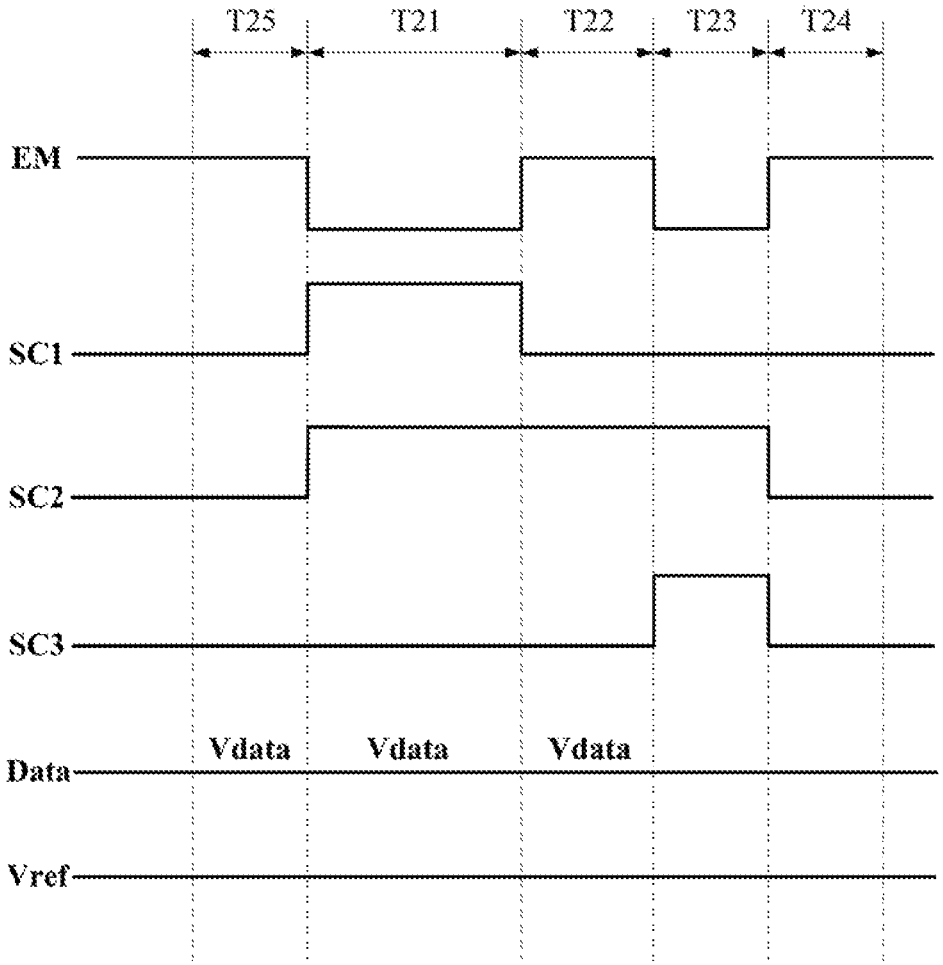
FIG. 9 illustrates another exemplary driving scheme of an exemplary pixel driving circuit in FIG. 3 consistent with disclosed embodiments.

As shown in FIG. 8 and FIG. 9, SC1, SC2, SC3, EM, Data, and Vref may refer to the signals provided to the first scan signal terminal Scan1, the second scan signal terminal Scan2, the third scan signal terminal Scan3, the light-emitting signal terminal Emit, the data signal terminal VDATA, and the initialization voltage signal terminal VREF, respectively. The high level and the low level here may represent only the relative relationship between the levels and are not limited to a certain level signal. The high level signal may be a signal for turning on the first to fifth transistors, and the low level signal may be a signal for turning off the first to fifth transistors.

FIG. 8 illustrates an exemplary driving scheme of exemplary pixel driving circuits in FIG. 2 and FIG. 4 consistent with disclosed embodiments.

For the pixel driving circuit 200 shown in FIG. 2, the first stage T11 may be the initialization stage. As shown in FIG. 8, in the first stage T11, the first level signal may be provided to the first scan signal terminal Scan1 and the second scan signal terminal Scan2, a second level signal may be provided to the light-emitting signal terminal Emit. The first initialization signal Vref may be provided to the initialization signal terminal VREF. The second initialization signal Vin may be provided to the data signal terminal VDATA. Accordingly, the first transistor M1 and the third transistor M3 may be turned on, and the first initialization signal Vref and the second Initialization signal Vin may be written into the node N3 and the node M1, respectively. Then the electric potential $V_{N1}$ of the node N1 may be Vin (i.e. $V_{N1}$=Vin), and the electric potential $V_{N3}$ of the node N3 may be Vref (i.e., $V_{N3}$=Vref).

Further, the voltage of the second initialization signal Vin may be greater than the sum of the voltage of the first initialization signal Vref and the threshold voltage Vth of the driving transistor, i.e., $V_{N1}-V_{N3}$=Vin−Vref>Vth. Accordingly, the driving transistor DT may be turned on at the bias voltage between the node N1 and the node N3 and, meanwhile, the node N2 may be the drain electrode of the driving transistor DT, and the node N3 may be the source electrode of the driving transistor DT.

When displaying the previous frame (i.e., the frame before and adjacent to the current frame), the driving transistor DT may turn on the OLED D1 to emit light, and the electric potential of the node N1 may be higher than the sum of the electric potential of the node N2 and the threshold voltage. Accordingly, the source electrode of the driving transistor DT may be the node N2, and the drain electrode of the driving transistor DT may the node N3. Thus, in the first stage T11, the driving transistor DT may be at a bias voltage opposite to the bias voltage for displaying the previous frame, such that the driving transistor DT may release the carriers captured during displaying the previous frame by non-charge traps in the channel and the insulating layer. Accordingly, the decay rate of carrier mobility in the pixel driving circuit may be substantially reduced, and the stability of the driving transistor may be improved.

For the pixel driving circuit 200 shown in FIG. 2, in the first stage T11 as shown in FIG. 8, the driving transistor DT may be turned on and the electric potential $V_{N2}$ of the node N2 may be the same as the potential $V_{N3}$ of the node N3, thus $V_{N2}$=Vref. To ensure that the OLED D1 does not emit light at the moment, the electric potential difference between the electric potential $V_{N2}$ at the node N2 and the electric potential $V_{PVEE}$ at the second voltage terminal PVEE may have to be smaller than the turn-on voltage Voled of OLED D1. That is, the voltage difference between the first initialization signal Vref and the signal $V_{PVEE}$ inputted from the second voltage terminal PVEE may be smaller than the turn-on voltage Voled of the OLED D1, i.e. Vref−$V_{PVEE}$<Voled.

The second stage T12 may be a stage in which the threshold voltage is acquired. In the second stage T12, the first level signal may be provided to the light-emitting signal terminal Emit and the second scan signal terminal Scan2, and the second level signal may be provided to the first scan signal terminal Scan1. The first signal Vin may be provided to the data signal terminal VDATA. The first signal Vin may be the same as the second initialization signal Vin.

Accordingly, the third transistor M3 may be turned on, and the electric potential $V_{N1}$ of the node N1 may be equal to Vin ($V_{N1}$=Vin). The second transistor M2 may be turned on, and the first voltage terminal PVDD may charge the first electrode of the driving transistor DT, thereby increasing the electric potential of the node N2. When the electric potential $V_{N2}$ of the node N2 increases to Vin−Vth, the driving transistor DT may be turned off and the first voltage terminal PVDD may stop charging the node N2. The electric potential of the node N3 may be Vin (i.e. $V_{N1}$=Vin), and the electric potential $V_{N2}$ of the node N2 is Vin−Vth (i.e. $V_{N2}$=Vin−Vth). The voltage difference between the node N1 and the node N2 may be maintained by the first capacitor C1.

In addition, to ensure that the OLED D1 does not emit light in the second stage T12, the-potential difference between the electric potential of the node N2 and the second voltage terminal PVEE may have to be smaller than the turn-on voltage Voled of the OLED D1. That is, the difference between the volt age of the second initialization signal Vin and the sum of the threshold voltage Vth of the driving transistor DT and the signal voltage $V_{PVEE}$ of the second voltage terminal PVEE may be smaller than the turn-on voltage Voled of the OLED, satisfying Vin−Vth−$V_{PVEE}$<Voled, i.e. Vin−(Vth+$V_{PVEE}$)<Voled.

The third stage T13 may be a stage for data writing. In the third stage T13, the second level signal may be provided to the first scan signal terminal Scan1 and the light-emitting signal terminal Emit, and the first level signal may be provided to the second scan signal terminal Scan2. The data signal Vdata may be provided to the data signal terminal VDATA. The data signal Vdata may be different from the first signal Vin. Accordingly, the third transistor M3 maybe turned on to transmit the data signal Vdata to the first node N1, meanwhile the electric potential $V_{N1}$ of the node N1 may be Vdata. From the second stage T12 to the third stage T13, the change of the electric potential of the node N1 may be Vdata−Vin and the node N2 may be in the floating state. Under the coupling effect of the first capacitor C1, the electric potential change of the node N2 may be (Vdata−Vin)·C01/(C01+C02). Thus, the electric potential of the N2 node may be $V_{N2}$=Vin−Vth+(Vdata−Vin)·C01/(C01+C02), where C01 and C02 are the capacitances of the first capacitor C1 and the second capacitor C2, respectively.

The fourth stage T14 may be a light-emitting stage. In the fourth stage T14, the first level signal may be provided to the light-emitting signal terminal Emit, and the second level signal may be provided to the first scan signal terminal Scan1 and the second scan signal terminal Scan2. The OLED D1 may emit light according to the voltage difference Vgs between the gate electrode (node N1) and the first electrode (node N2) of the driving transistor DT. Then the source electrode of the driving transistor DT may be the node N2, and the gate-source electric potential difference may be Vgs=$V_{N1}$−$V_{N2}$=Vdata−Vin+Vth−(Vdata−Vin)·C01/(C01+C02). The light-emitting current Ids of the OLED D1 may be calculated by the following equation (1):

$$\begin{aligned} Ids &= K(Vgs - |Vth|)^2 \\ &= K\left[Vdata - Vin + Vth - \frac{CO1}{CO1 + CO2}\cdot(Vdata - Vin) - Vth\right]^2 \\ &= K\left[Vdata - Vin - \frac{CO1}{CO1 + CO2}\cdot(Vdata - Vin)\right]^2, \end{aligned} \tag{1}$$

where K is the coefficient associated with the channel width to length ratio of the driving transistor DT. According to the Equation (1), the light-emitting current Ids of the OLED D1 may be independent of the threshold voltage Vth of the driving transistor DT. Thus, the pixel driving circuit 200 shown in FIG. 2 may compensate the threshold voltage of the driving transistor DT. In addition, the driving transistor DT may be at biases in different directions during the operating process, thereby effectively reducing the decay rate of the driving transistor and improving the display performance.

The second stage T12, the third stage T13, and the fourth stage T14 of the driving method for the pixel driving circuit 400 shown in FIG. 4 may have the same operating principles as for the pixel driving circuit 200 shown in FIG. 2, which will not be further described here.

The difference of the driving method between the pixel driving circuit 400 and the pixel driving circuit 200 may be in she first stage T11. In the first stage T11, the electric potential $V_{N2}$ of the node N2 may be equal to Vref (i.e. $V_{N2}$=Vref). In FIG. 4, given the fifth transistor M5 is turned off in the first stage T11, the electric potential of the node N2 may not be transmitted to the anode of the OLED D1. Accordingly, the first initialization signal Vref may not cause the OLED D1 to emit light. That is, in the first stage, the first initialization signal may have to satisfy Vin−Vref>Vth for the pixel driving circuit 400 shown in FIG. 4, without having to satisfy Vref−$V_{PVEE}$<Voled which is required for the pixel diving circuit 200 shown in FIG. 2.

In one embodiment, as shown in FIG. 8, the disclosed driving method may further include the fifth stage T15. The fifth stage T15 may be before the first stage T11 or after the fourth stage T14 (the fifth stage T15 may be before the first stage T11 in FIG. 8). In the fifth stage, the second level signal may be provided to the first scan signal terminal Scan1, the second scan signal terminal Scan2, and the light-emitting signal terminal Emit. Accordingly, each transistor in the pixel driving circuit 200 or 400 may be turned off.

Thus, the state of each transistor in the pixel driving circuit may be reset in the fifth stage T15 before displaying the current frame or after displaying the current frame, such that the state of the transistor in the pixel driving circuit for displaying the current frame may not be affected by the slate of the transistor in the pixel driving circuit for displaying the previous adjacent frame, or the state of the transistor in the pixel driving circuit for displaying the next frame may not be affected by the state of the transistor in the pixel driving circuit for displaying the current adjacent frame. Accordingly, two consecutive frames may be displayed without interfering with each other.

FIG. 9 illustrates another exemplary driving scheme of an exemplary pixel driving circuit in FIG. 3 consistent with disclosed embodiments.

As shown in FIG. 9, for the pixel driving circuit 300 shown in FIG. 3, the first stage T21 may be an initialization stage. In the first stage T21, the first level signal may be provided to the first scan signal terminal Scan1 and the second scan signal terminal Scan2, and the second level signal may be provided to the third scan signal terminal Scan3 and the light-emitting signal terminal Emit. The first initialization signal Vref may be provided to the initialization signal terminal VREF, and the second initialization signal Vdata may be provided to the data signal terminal VDATA. The second initialization signal Vdata may be used as a data signal for turning on the OLED D1.

Accordingly, the first transistor M1 and the third transistor M3 may be turned on, such that the first initialization signal Vref and the second initialization signal Vdata may be written into the node N3 and the node N1, respectively. Then the electric potential $V_{N1}$ of the node N1 may be equal to Vdata ($V_{N1}$=Vdata), and the electric potential $V_{N3}$ of the node N3 may be equal to Vref ($V_{N3}$=Vref). The voltage of the second initialization signal Vdata may be greater than the sum of the voltages of the first initialization signal Vref and the threshold voltage Vth of the driving transistor, i.e. $V_{N1}-V_{N3}$=Vdata−Vref>Vth. Accordingly, the driving transistor DT may be turned on under the bias voltage between the node N1 and the node N3. The nodes N2 and N1 may be the drain electrode and gate electrode of the driving transistor DT, respectively.

When displaying the previous adjacent frame, the driving transistor DT may turn on the OLED D1 to emit light, and the electric potential of the node N1 may be higher than the sum of the electric potential of the node N2 and the threshold voltage. The source electrode of the driving transistor DT may be the node N2 and the drain electrode may be the node N3.

Accordingly, in she first stage T21, the driving transistor DT may be at a bias voltage opposite to the bias voltage in image displaying of the prior frame, such that the driving transistor DT may release the carriers captured during the image display of the prior frame by non-charge traps in the channel and the insulating layer. Accordingly, the decay rate of carrier mobility in the pixel driving circuit may be substantially reduced, and the stability of the driving transistor may be improved.

As shown in FIG. 9, in the first stage T21, the driving transistor DT may be turned on and the electric potential $V_{N2}$ of the node N2 may be the same as the electric potential $V_{N3}$ of the node N3, i.e. $V_{N3}$=Vref. To ensure that the OLED D1 does not emit light at the moment, the electric potential difference between the the node N2 and the second voltage terminal PVEE may have to be smaller than the turn-on voltage of the OLED D1. That is, the voltage difference between the first initialization signal Vref and the signal $V_{PVEE}$ inputted from the second voltage terminal PVEE may be smaller than the turn-on voltage Voled of the OLED D1, i.e. Vref−$V_{PVEE}$<Voled.

The second stage T22 may be a stage in which the threshold voltage is acquired. In the second stage T22, the first level signal maybe provided to the light-emitting signal terminal Emit and the second scan signal terminal Scan2, and the second level signal may be provided to the first scan signal terminal Scan1 and the third scan signal terminal Scan3. The data signal terminal VDATA may be provided with a first signal Vdata, which is the same as the first initialization signal Vdata provided to the data signal terminal VDATA in the first stage.

Accordingly, the third transistor M3 may be turned on, and the electric potential $V_{N1}$ of the node N1 may be equal to Vdata ($V_{N1}$=Vdata). The second transistor M2 may be turned on, and the first voltage terminal PVDD may charge the first electrode of the driving transistor DT, and may increase the electric potential of the node N2. When the electric potential $V_{N2}$ of the node N2 increases to Vdata−Vth, the driving transistor DT may be turned off and the first voltage terminal PVDD may stop charging the node N2.

Accordingly, the electric potential $V_{N1}$ of the node N1 may be equal to Vdata (i.e. $V_{N1}$=Vdata), and the electric potential $V_{N2}$ of the node N2 maybe equal to Vdata−Vth ($V_{N2}$=Vdata−Vth), and the voltage difference between the node N1 and the node N2 may be held by the first capacitor C1. In addition, to ensure that the OLED D1 does not emit light in the second stage T22, the electric potential difference between t the node N2 and the second voltage terminal PVEE may have to be smaller than the turn-on voltage Voled of the OLED D1, i.e., Vdata−Vth−$V_{PVEE}$<Voled. That is, the difference between the voltage of the second initialization signal Vdata and the sum of the threshold voltage Vth of the driving transistor DT and the signal voltage $V_{PVEE}$ of the second voltage terminal may be smaller than the turn-on voltage Voled of the OLED.

The third stage T23 may be a data writing stage. In the third stage T23, the second level signal may be provided to the first scan signal terminal Scan1, the second scan signal terminal Scan2, and the light-emitting signal terminal Emit, and the first level signal may be provided to the third scan signal terminal Scan3. The data signal terminal VDATA may be provided with a data signal Vdata which is the same as the first initialization signal Vdata provided to the data signal terminal VDATA in the first stage.

Accordingly, the fourth transistor M4 may be turned on to transmit the signal $V_{PVDD}$ inputted from the first voltage terminal PVDD to the first node N1, then the potential $V_{N1}$ of the node N1 may be equal to $V_{PVDD}$ (i.e. $V_{N1}=V_{PVDD}$). From the second stage T22 to the third stage T23, the change in the electric potential of the node N1 may be $V_{PVDD}$−Vdata. The signal $V_{PVDD}$ of the first voltage terminal PVDD may be different from the first signal Vdata. That is, the amount of potential change of the node N1 may not be zero. Under the coupling effect of the first capacitor C1, the electric potential change of the node N2 may be ($V_{PVDD}$−Vdata)·C01/(C01+C02). Accordingly, the electric potential of the node N2 may be $V_{N2}$=Vdata−Vth+($V_{PVDD}$−Vdata)·C01/(C01+C02), where C01 and C02 are the capacitances of the first capacitor C1 and the second capacitor C2, respectively.

The fourth stage T24 may be a fight-emitting stage. In the fourth stage T24, the first level signal may be provided to the light emitting signal terminal Emit, and the second level signal may be provided to the first scan signal terminal Scan1, the second scan signal terminal Scan2, and the third scan signal terminal Scan3. The OLED D1 may emit light according to the voltage difference Vgs between the gate electrode (node N1) and the first electrode (node N2) of the driving transistor DT. Then the source electrode of the driving transistor DT may be the node N2 and the electric potential difference between the gate electrode and the first electrode of the driving transistor DT may be Vgs=$V_{N1}-V_{N2}=V_{PVDD}$−Vdata+Vth−($V_{PVDD}$−Vdata)·C01/(C01+C02). The light-emitting current Ids of the OLED D1 may be calculated by the following equation (2):

$$\begin{aligned} Ids &= K(Vgs-|Vth|)^2 \\ &= K\left[V_{PVDD}-Vdata+Vth-\frac{CO1}{CO1+CO2}\cdot(V_{PVDD}-Vdata)-Vth\right]^2 \\ &= K\left[V_{PVDD}-Vdata-\frac{CO1}{CO1+CO2}\cdot(V_{PVDD}-Vdata)\right]^2, \end{aligned} \tag{2}$$

where K is the coefficient associated with the channel width to length ratio of the driving transistor DT. According to the equation (2), the light-emitting current Ids of the OLED D1 may be independent of the threshold voltage Vth of the driving transistor DT. Thus, the pixel driving circuit 300 shown in FIG. 3 may compensate the threshold voltage of the driving transistor DT. In addition, the driving transistor DT may be biased in different directions during the operation process, thereby effectively reducing the decay rate of the driving transistor and improving the display performance.

In one embodiment, for the pixel driving circuit 300 shown in FIG. 3, the driving method thereof may include the fifth stage T25, which may be before the first stage T21 or after the fourth stage T24 (the fifth stage T25 may be before the first stage T21 in FIG. 9). In the fifth stage T25, the second level signal may be provided to the first scan signal terminal Scan1, the second scan signal terminal Scan2, the third scan signal terminal Scan3, and the light-emitting signal terminal Emit. Accordingly, each transistor in the pixel drive circuit 300 may be turned off. Thus, the state of each transistor in the pixel driving circuit may be reset in the fifth stage T15 before displaying the current frame or after displaying the current frame, such that the state of the transistor in the pixel driving circuit for displaying the current frame may not be affected by the state of the transistor in the pixel driving circuit for displaying the previous adjacent frame, or the state of the transistor in the pixel driving circuit tor displaying the next frame may not be affected by the state of the transistor in the pixel driving circuit for displaying the current adjacent frame. Accordingly, two consecutive frames may be displayed without interfering with each other.

The disclosed pixel driving method may further include: in the first stage, second stage, third stage and fourth stage, providing a first voltage signal to the voltage terminal PVDD and a second voltage signal to the second voltage terminal PVEE; providing the first voltage signal and second voltage signal each having a constant voltage value, in which the voltage of the first signal is higher than the voltage of the second voltage signal.

In FIG. 9, the signal of the data signal terminal VDATA in the operating sequence of the exemplary pixel driving circuit 300 may have a constant voltage value. Compared with the operation sequence based on the pixel driving circuit 200 or 400 shown in FIG. 3, the pixel driver circuit 300 may simplify the signal transmitted by the data signal terminal VDATA, improve the stability of the signal of the data signal terminal VDATA, and prevent the operation state of the pixel driving circuit from being affected by the signal variation on the data signal terminal VDATA, thereby improving the display performance.

In the disclosed embodiments, based on the driving method described in conjunction with FIG. 8 and FIG. 9, the organic light-emitting display panel and the driving method thereof may cause the driving transistor in each pixel driving circuit to operate at different bias voltages during the display of each image frame, thereby reducing the decay rate of carrier mobility of the driving transistors, increasing the operation lifetime of the driving transistors, and enhancing the display performance of the organic light-emitting display panel.

Figure 10:
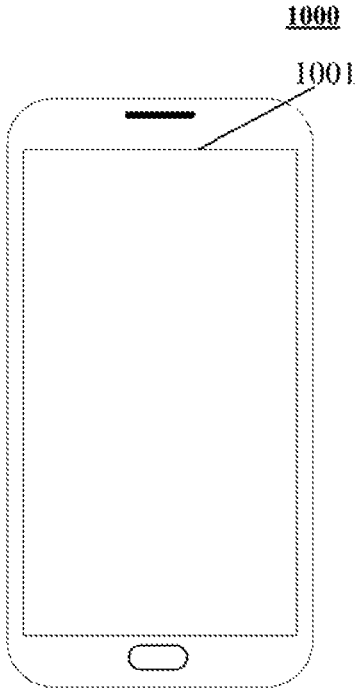
FIG. 10 illustrates a schematic view of an exemplary organic light-emitting display device consistent with disclosed embodiments.

The present disclosure also provides an organic light-emitting display device. FIG. 10 illustrates a schematic view of an exemplary organic light-emitting display device 1000 consistent with disclosed embodiments. As shown in FIG. 10, the organic light-emitting display device 1000 may include any one of the disclosed organic light-emitting display panels 1001. The disclosed organic light-emitting display device 1000 may be a cell phone, a tablet, a monitor, and a smart wearable display device, etc. Any organic light-emitting display device comprising any one of the disclosed organic light-emitting display panels will fall within the scope of the present disclosure. Although a smart phone is shown in FIG. 10, the disclosed organic light-emitting display device is not limited to the smart phone. It should be understood that, the organic light-emitting display device 1000 may also include packaging film, protective glass and other suitable structures, which will not be further described here.

An organic light-emitting display panel, a driving method, and an organic light-emitting display device are provided in the present disclosure. The organic light-emitting display panel may include a plurality of pixel driving circuits arranged in a matrix. Each pixel driving circuit may include a driving module, an initialization module, a data writing module, a light-emitting control module and an OLED. The driving module may include a driving transistor and a first capacitor.

The initialization module may include a first transistor. The gate electrode of the first transistor, and the first and second electrodes of the first transistor may be electrically connected to the first scan signal terminal, the initialization signal terminal and the second electrode of the driving transistor, respectively. The data writing module may be used for transmitting a signal of the data signal terminal to the driving transistor under control of the second scan signal terminal. The light-emitting control module may include a second transistor. The gate electrode and the first and second electrodes of the second transistor may be electrically connected to the light-emitting signal terminal, the first voltage terminal, and the second electrode of the dosing transistor, respectively The disclosed organic light-emitting display panel and driving method thereof may reduce the decay rate of carrier mobility of the driving transistors, increase the operation lifetime of the driving transistors, and ensure the display performance of the organic light-emitting display panel.

The description of the disclosed embodiments is provided to illustrate the present invention to those skilled in the art. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An organic light-emitting display panel, comprising:

a plurality of pixel driving circuits arranged in a matrix, wherein a pixel driving circuit includes:

a first scan signal terminal, a second scan signal terminal, and a third scan signal terminal;

a light-emitting signal terminal, a data signal terminal, an initialization signal terminal, a first voltage terminal, and a second voltage terminal;

a driving module comprising a driving transistor and a first capacitor having two electrode plates electrically connected to a gate electrode and a first electrode of the driving transistor, respectively;

an initialization module comprising a first transistor having a gate electrode electrically connected to the first scan signal terminal, a first electrode electrically connected to the initialization signal terminal, and a second electrode electrically connected to a second electrode of the driving transistor;

a data writing module electrically connected to the gate electrode of the driving transistor, wherein:

the data writing module further comprises a third transistor and fourth transistor;

a first electrode of the third transistor is electrically connected to the data signal terminal;

a gate electrode of the fourth transistor is electrically connected to the third scan signal terminal;

a first electrode of the four transistor is electrically connected to the first voltage terminal; and a second electrode of the fourth transistor is directly connected to a second electrode of the third transistor and a gate electrode of the driving transistor;

a light-emitting control module comprising a second transistor having a gate electrode electrically connected to the light-emitting signal terminal, a first electrode electrically connected to the first voltage terminal, and a second electrode electrically connected to the second electrode of the driving transistor; and an organic light-emitting element having a cathode electrically connected to the second voltage terminal, wherein:

during an initialization stage, a first level signal is provided to the first scan signal terminal and the second scan signal terminal, and a second level signal different from the first level signal is provided to the light-emitting signal terminal and the third scan signal terminal, thereby turning on the driving transistor and turning off the fourth transistor.

2. The organic light-emitting display panel according to claim 1, wherein:

the driving transistor is configured to provide a light-emitting current to the organic light-emitting element under a control of the light-emitting control module; and the data writing module is configured to transmit a data signal at the data signal terminal to the driving transistor under a control of the second scan signal terminal.

3. The organic light-emitting display panel according to claim 2, wherein:

a gate electrode of the third transistor is electrically connected to the second scan signal terminal.

4. The organic light-emitting display panel according to claim 2, wherein:

the light-emitting control module further includes a second capacitor; and two electrode plates of the second capacitor are electrically connected to the first voltage terminal and the first electrode of the driving transistor, respectively.

5. The organic light-emitting display panel according to claim 2, wherein:

the data writing module is also configured to transmit a signal at the first voltage terminal to the driving transistor under a control of the third scan signal terminal.

6. The organic light-emitting display panel according to claim 2, wherein:

the first electrode of the driving transistor is electrically connected to an anode of the organic light-emitting element.

7. The organic light-emitting display panel according to claim 2, further including a plurality of first scan signal lines, a plurality of second scan signal lines, a plurality of light-emitting signal lines, a plurality of data signal lines, at least one initialization signal line, a first voltage signal line and a second voltage signal line, wherein:

the first scan signal terminal of the pixel driving circuit is electrically connected to a first scan signal line of the plurality of first scan signal lines;

the second scan signal terminal of the pixel driving circuit is electrically connected to a second scan signal line of the plurality of second scan signal lines;

the light-emitting signal terminal of the pixel driving circuit is electrically connected to a light-emitting signal line of the plurality of light-emitting signal lines;

the data signal terminal of the pixel driving circuit is electrically connected to a data signal line of the plurality of data signal lines;

the initialization signal terminal of the pixel driving circuit is electrically connected to an the at least one initialization signal line;

the first voltage terminal of the pixel driving circuit is electrically connected to the first voltage signal line; and the second voltage terminal of the pixel driving circuit is connected to the second voltage signal line.

8. The organic light-emitting display panel according to claim 7, wherein:

a first scan signal line is electrically connected to a plurality of first scanning signal terminals of one row of pixel driving circuits, respectively;

a second scan signal line is electrically connected to a plurality of second scan signal terminals of one row of pixel driving circuits, respectively;

a light-emitting signal line is electrically connected to a plurality of light-emitting signal terminals of one row of pixel driving circuits, respectively;

a data signal line is electrically connected to a plurality of data signal terminals of one column of pixel driving circuits, respectively;

an initialization signal line is electrically connected to a plurality of initialization signal terminals of one column of pixel driving circuits, respectively;

the first voltage terminal of the pixel driving circuit is electrically connected a same first voltage signal line; and the second voltage terminal of the pixel driving circuit is electrically connected to a same second voltage signal line.

9. The organic light-emitting display panel according to claim 8, wherein:

the initialization signal terminal of the pixel driving circuit is electrically connected to a same initialization signal line.

10. The organic light-emitting display panel according to claim 1, wherein:

the organic light-emitting element is an organic light-emitting diode (OLED).

11. An organic light-emitting display device, comprising the organic light-emitting display panel according to claim 1.

12. The organic light-emitting display panel according to claim 1, wherein:

the initialization module provides a first initialization signal to the second electrode of the driving transistor, the data writing module provides a second initialization signal to the gate electrode of the driving transistor, and a voltage of the second initialization signal is greater than a sum of a voltage of the first initialization signal and a threshold voltage of the driving transistor.

13. The organic light-emitting display panel according to claim 4, wherein:

the first capacitor and the second capacitor divide a voltage difference generated by charges produced due to a coupling effect of the first capacitor.

14. An organic light-emitting display panel, comprising:

a plurality of pixel driving circuits arranged in a matrix, wherein a pixel driving circuit includes:

a first scan signal terminal, a second scan signal terminal and a third scan signal terminal;

a light-emitting signal terminal, a data signal terminal, an initialization signal terminal, a first voltage terminal, and a second voltage terminal;

a driving module comprising a driving transistor and a first capacitor having two electrode plates electrically connected to a gate electrode and a first electrode of the driving transistor, respectively;

an initialization module comprising a first transistor having a gate electrode electrically connected to the first scan signal terminal, a first electrode electrically connected to the initialization signal terminal, and a second electrode electrically connected to a second electrode of the driving transistor;

a data writing module electrically connected to the gate electrode of the driving transistor wherein:

the data writing module further includes a third transistor and a fourth transistor, a first electrode of the third transistor is electrically connected to the data signal terminal, a gate electrode of the fourth transistor is electrically connected to the third scan signal terminal, a first electrode of the four transistor is electrically connected to the first voltage terminal, and a second electrode of the fourth transistor is directly connected to a second electrode of the third transistor and the gate electrode of the driving transistor;

a light-emitting control module comprising a second transistor and a second capacitor, the second transistor having a gate electrode electrically connected to the light-emitting signal terminal, a first electrode electrically connected to the first voltage terminal, and a second electrode electrically connected to the second electrode of the driving transistor, two electrode plates of the second capacitor being directly connected to the first electrode of the driving transistor and the second electrode of the driving transistor, respectively; and an organic light-emitting element having a cathode electrically connected to the second voltage terminal.

15. The organic light-emitting display panel according to claim 14, wherein:

the driving transistor is configured to provide a light-emitting current to the organic light-emitting element under a control of the light-emitting control module; and the data writing module is configured to transmit a data signal at the data signal terminal to the driving transistor under a control of the second scan signal terminal.

16. The organic light-emitting display panel according to claim 15, wherein:

a gate electrode of the third transistor is electrically connected to the second scan signal terminal; and the second electrode of the third transistor is electrically connected to the gate electrode of the driving transistor.

17. The organic light-emitting display panel according to claim 15, wherein:

the data writing module is also configured to transmit a signal at the first voltage terminal to the driving transistor under a control of the third scan signal terminal.

18. The organic light-emitting display panel according to claim 17, wherein:

during an initialization stage, a first level signal is provided to the first scan signal terminal and the second scan signal terminal, and a second level signal different from the first level signal is provided to the light-emitting signal terminal and the third scan signal terminal, thereby turning on the driving transistor and turning off the fourth transistor.

19. An organic light-emitting display panel, comprising:

a plurality of pixel driving circuits arranged in a matrix, wherein a pixel driving circuit includes:

a first scan signal terminal and a second scan signal terminal;

a light-emitting signal terminal, a data signal terminal, an initialization signal terminal, a first voltage terminal, and a second voltage terminal;

a driving module comprising a driving transistor and a first capacitor having two electrode plates electrically connected to a gate electrode and a first electrode of the driving transistor, respectively;

an initialization module comprising a first transistor having a gate electrode electrically connected to the first scan signal terminal, a first electrode electrically connected to the initialization signal terminal, and a second electrode electrically connected to a second electrode of the driving transistor;

a data writing module electrically connected to the gate electrode of the driving transistor wherein:

the data writing module further includes a third transistor and a fourth transistor, a first electrode of the third transistor is electrically connected to the data signal terminal, a gate electrode of the fourth transistor is electrically connected to the third scan signal terminal, a first electrode of the four transistor is electrically connected to the first voltage terminal, and a second electrode of the fourth transistor is directly connected to a second electrode of the third transistor and the gate electrode of the driving transistor;

a light-emitting control module comprising a second transistor having a gate electrode electrically connected to the light-emitting signal terminal, a first electrode electrically connected to the first voltage terminal, and a second electrode electrically connected to the second electrode of the driving transistor; and an organic light-emitting element having a cathode electrically connected to the second voltage terminal, wherein:

the initialization module provides a first initialization signal to the second electrode of the driving transistor, the data writing module provides a second initialization signal to the gate electrode of the driving transistor, and a voltage of the second initialization signal is greater than a sum of a voltage of the first initialization signal and a threshold voltage of the driving transistor.

20. The organic light-emitting display panel according to claim 19, wherein:

during an initialization stage, a first level signal is provided to the first scan signal terminal and the second scan signal terminal, and a second level signal different from the first level signal is provided to the light-emitting signal terminal and the third scan signal terminal, thereby turning on the driving transistor and turning off the fourth transistor.

* * * * *